US008787788B2

(12) United States Patent
Koujiri et al.

(10) Patent No.: US 8,787,788 B2
(45) Date of Patent: Jul. 22, 2014

(54) IMAGE FORMING APPARATUS

(75) Inventors: Tetsunao Koujiri, Kanagawa (JP); Taku Fukuhara, Kanagawa (JP); Yoko Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 226 days.

(21) Appl. No.: 13/206,123

(22) Filed: Aug. 9, 2011

(65) Prior Publication Data

US 2012/0195624 A1 Aug. 2, 2012

(30) Foreign Application Priority Data

Jan. 28, 2011 (JP) ..... 2011-016561

(51) Int. Cl.
*G03G 15/16* (2006.01)

(52) U.S. Cl.
USPC ..... 399/101; 399/347; 399/345

(58) Field of Classification Search
USPC ..... 399/101, 347, 345
See application file for complete search history.

(56) References Cited

U.S. PATENT DOCUMENTS

| | | | | |
|---|---|---|---|---|
| 5,740,495 | A * | 4/1998 | Maher et al. | 399/71 |
| 6,061,543 | A * | 5/2000 | Kayahara et al. | 399/302 |
| 7,274,888 | B2 * | 9/2007 | Tomizawa | 399/49 |
| 8,107,848 | B2 * | 1/2012 | Nozawa et al. | 399/101 |

FOREIGN PATENT DOCUMENTS

| | | | |
|---|---|---|---|
| JP | 05-273893 | A | 10/1993 |
| JP | 05-313526 | A | 11/1993 |
| JP | 2005-326770 | A | 11/2005 |
| JP | 2006-003604 | A | 1/2006 |

* cited by examiner

*Primary Examiner* — David Gray
*Assistant Examiner* — Michael Harrison
(74) *Attorney, Agent, or Firm* — Sughrue Mion, PLLC

(57) ABSTRACT

An image forming apparatus includes an image holding body that holds an electrostatic latent image; a developing device that develops the electrostatic latent image with a toner and forms a toner image on the image holding body; a transfer member having a fluorocarbon resin dispersion layer at least at a surface layer of the transfer member, fluorocarbon resin being dispersed in the fluorocarbon resin dispersion layer; a first transfer device that first-transfers the toner image, which is formed on the image holding body, on the transfer member; a second transfer device that second-transfers the toner image, which is first-transferred on the transfer member, on a recording medium; and an abrading member that is arranged to come into contact with and be separated from the transfer member and abrades part of the surface layer of the transfer member when the abrading member contacts the transfer member.

4 Claims, 3 Drawing Sheets

IMAGE FORMING APPARATUS

CROSS-REFERENCE TO RELATED APPLICATIONS

This application is based on and claims priority under 35 USC 119 from Japanese Patent Application No. 2011-016561 filed Jan. 28, 2011.

BACKGROUND

The present invention relates to an image forming apparatus.

SUMMARY

According to an aspect of the invention, there is provided an image forming apparatus including an image holding body that holds an electrostatic latent image; a developing device that develops the electrostatic latent image with a toner and forms a toner image on the image holding body; a transfer member having a fluorocarbon resin dispersion layer at least at a surface layer of the transfer member, fluorocarbon resin being dispersed in the fluorocarbon resin dispersion layer; a first transfer device that first-transfers the toner image, which is formed on the image holding body, on the transfer member; a second transfer device that second-transfers the toner image, which is first-transferred on the transfer member, on a recording medium; and an abrading member that is arranged to come into contact with and be separated from the transfer member and abrades part of the surface layer of the transfer member when the abrading member contacts the transfer member.

BRIEF DESCRIPTION OF THE DRAWINGS

Exemplary embodiment(s) of the present invention will be described in detail based on the following figures, wherein.

DETAILED DESCRIPTION

An image forming apparatus according to an exemplary embodiment of the present invention will be described below with reference to the accompanying drawings.

General Configuration

Figure 1:
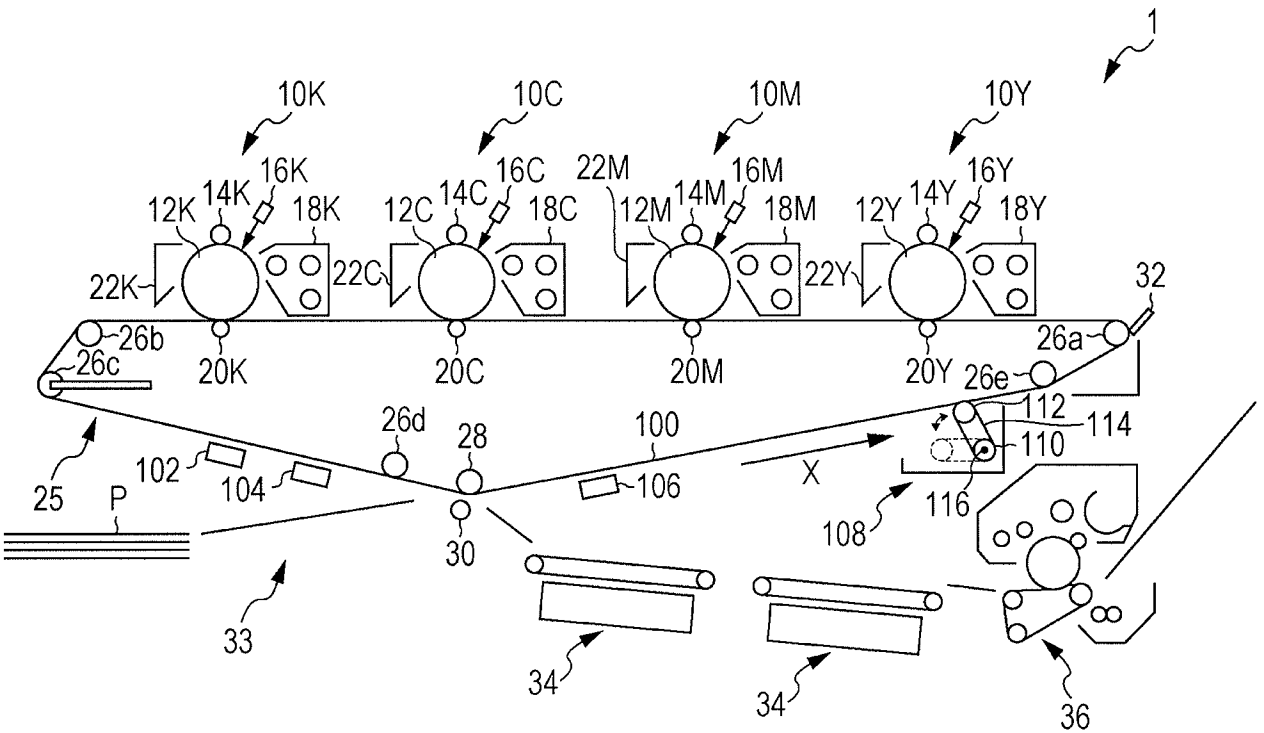
FIG. 1 is a general configuration diagram showing an overview of a configuration of an image forming apparatus according to an exemplary embodiment of the present invention.

FIG. 1 illustrates an example configuration of the image forming apparatus according to the exemplary embodiment of the present invention.

An image forming apparatus 1 according to this exemplary embodiment includes image forming units 10Y, 10M, 10C, and 10K (Y is for yellow, M is for magenta, C is for cyan, and K is for black). The image forming units 10Y, 10M, 10C, and 10K respectively include photoconductor drums 12Y, 12M, 12C, and 12K, which are an example of an image holding body. Provided respectively around the photoconductor drums 12Y, 12M, 12C, and 12K are charging devices 14Y, 14M, 14C, and 14K that charge surfaces of the photoconductor drums 12Y, 12M, 12C, and 12K; exposure devices 16Y, 16M, 16C, and 16K that form electrostatic latent images on the surfaces of the photoconductor drums 12Y, 12M, 12C, and 12K; developing devices 18Y, 18M, 18C, and 18K that develop the electrostatic latent images formed on the surfaces of the photoconductor drums 12Y, 12M, 12C, and 12K into toner images by using toners contained in developers; first transfer devices 20Y, 20M, 20C, and 20K formed of, for example, transfer rollers that first-transfer the toner images on a transfer belt 100; and photoconductor drum cleaners 22Y, 22M, 22C, and 22K that remove remaining toners adhering to the surfaces of the photoconductor drums 12Y, 12M, 12C, and 12K after the transfer.

The transfer belt 100, which is an example of a transfer member, is arranged to face the image forming units 10Y, 10M, 100, and 10K. The transfer belt 100 is arranged between the photoconductor drums 12Y, 12M, 12C, and 12K, and the first transfer devices 20Y, 20M, 20C, and 20K. Transfer current flows through the first transfer devices 20Y, 20M, 20C, and 20K. The transfer current causes an electric field to act between the photoconductor drums 12Y, 12M, 12C, and 12K, and the transfer belt 100.

The transfer belt 100 is rotatably supported by (rotatably extends around) a driving roller 26*a*, a tension steering roller 26*c* that prevents the transfer belt 100 from warping or meandering, and support rollers 26*b*, 26*d*, and 26*e*, while a backup roller 28 applies a tension to the transfer belt 100 from an inner periphery side. The plural rollers 26*a*, 26*b*, 26*c*, 26*d*, and 26*e* that support the transfer belt 100, and a motor (not shown) that rotates the driving roller 26*a* define a belt driving device 25.

A second transfer device 30 formed of, for example, a transfer roller, is arranged at the periphery of the transfer belt 100 to face the backup roller 28 with the transfer belt 100 interposed therebetween. Also, a corotron charger 102, which is an example of a charge applying portion, and a first reflection density sensor 104 are arranged upstream of the second transfer device 30 in a rotation direction (indicated by arrow X in FIG. 1) of the transfer belt 100. A second reflection density sensor 106, an abrading device 108, and a belt cleaner 32 are arranged downstream of the second transfer device 30 in the rotation direction of the transfer belt 100.

Though described later, the corotron charger 102 applies a charge to a toner on the transfer belt 100. The first reflection density sensor 104 detects a density of a toner image on the transfer belt 100 before second transfer. The second reflection density sensor 106 detects a density of a remaining toner image on the transfer belt 100 after the second transfer. The first reflection density sensor 104 and the second reflection density sensor 106 define a second transfer ratio detecting device.

The abrading device 108 includes two driven rollers 110 and 112, an abrading belt 114, which is an example of an abrading member, supported by the two driven rollers 110 and 112, and a driving device 116 that drives the driven roller 112 around the driven roller 110 and hence allows the abrading belt 114 to come into contact with and be separated from the transfer belt 100. The abrading belt 114 is formed of a material with a higher hardness than a hardness of a base material (described later) of the transfer belt 100. For example, the abrading belt 114 is formed of a metal belt with a surface thereof blasted, or a rubber belt in which an inorganic substance, such as aluminum oxide, silica, diamond, or boron nitride (CBN), is mixed as abrasive grains. When the abrading belt 114 comes into contact with the transfer belt 100, a surface layer of the transfer belt 100 is abraded.

The belt cleaner 32 removes a toner remaining on an outer peripheral surface of the transfer belt 100 and removes chips of the transfer belt 100 by the abrading device 108.

Also, provided around the second transfer device 30 are a paper feed device 33 that transports and feeds a piece of recording paper P, which is an example of a recording medium, to the second transfer device 30; a transport device 34 that transports the recording paper P after the second transfer by the second transfer device 30; and a fixing device 36 that is provided downstream of the transport device 34 in a transport direction by the transport device 34 and fixes a toner image transferred on the recording paper P.

In the image forming apparatus 1 according to this exemplary embodiment, the photoconductor drum 12Y of the image forming unit 10Y rotates clockwise in FIG. 1, and the surface of the photoconductor drum 12Y is charged by the charging device 14Y. An electrostatic latent image with a first color (Y) is formed on the charged photoconductor drum 12Y by the exposure device 16Y, such as a laser writing device.

This electrostatic latent image is developed with a toner (a developer containing a toner) supplied from the developing device 18Y. Thus, a visualized toner image is formed. The toner image reaches a first transfer portion by rotation of the photoconductor drum 12Y. The first transfer device 20Y causes an electric field with a reversed polarity to act on the toner image. Thus, the toner image is first-transferred on the transfer belt 100.

Similarly, a toner image (M) with a second color, a toner image (C) with a third color, and a toner image (K) with a fourth color are successively formed by the image forming units 10M, 10C, and 10K, and are superposed on each other on the transfer belt 100. Thus, a multilayered toner image is formed.

Then, the multilayered toner image transferred on the transfer belt 100 reaches a second transfer portion by rotation of the transfer belt 100. The second transfer device 30 is arranged at the second transfer portion. At the second transfer portion, a bias (transfer voltage) with a reversed polarity that is opposite to the polarity of the toner image is applied between the second transfer device 30 and the backup roller 28, which faces the second transfer device 30 with the transfer belt 100 interposed therebetween, from the second transfer device 30 side. Accordingly, the toner image is transferred on the recording paper P by electrostatic attraction.

To be more specific, the recording paper P is picked up one by one by a pickup roller (not shown) from a bundle of recording paper housed in a recording paper container (not shown). The recording paper P is fed to the second transfer portion between the transfer belt 100 and the second transfer device 30 by a feed roller (not shown) at a predetermined timing. Then, the toner image held by the transfer belt 100 is transferred on the fed recording paper P by pinching the recording paper P by the second transfer device 30 and the backup roller 28 and applying the transfer voltage.

The recording paper P with the toner image transferred thereon is transported by the transport device 34 to the fixing device 36. The toner image is fixed by pressure/heat processing, and hence the toner image becomes a permanent image.

The belt cleaner 32 provided downstream of the second transfer portion removes the toner remaining on the outer peripheral surface of the transfer belt 100 after the transfer of the multilayered toner image on the recording paper P is completed. Thus, the transfer belt 100 prepares for the next transfer. Also, the second transfer device 30 is provided with a cleaning member (not shown). The cleaning member removes toner particles and foreign matters such as paper dusts adhering to the second transfer device 30 during the transfer.

When a single-color image is transferred, a toner image after first transfer is second-transferred with a single color, and is transported to the fixing device 36. When a multi-color image formed by superposing plural colors is transferred, the transfer belt 100 is rotated in synchronization with rotation of the photoconductor drums 12Y, 12M, 12C, and 12K so that toner images of respective colors are aligned with each other at the first transfer portion, to prevent the toner images of the respective colors from being shifted from each other.

As described above, with the image forming apparatus 1 according to this exemplary embodiment, an image is formed on a piece of recording paper P.

The image forming apparatus 1 according to this exemplary embodiment uses a toner with a very small particle diameter (an average of 4 μm) to improve quality of an image. Since such a very small toner has a high absorptivity to the transfer belt 100, a second transfer ratio is generally low. Therefore, with the image forming apparatus 1 according to this exemplary embodiment, a belt having a fluorocarbon resin dispersion layer, in which fluorocarbon resin is dispersed in a surface layer, is used as the transfer belt 100. Accordingly, releasing performance for a toner is increased, and the second transfer ratio is increased.

Figure 2A:
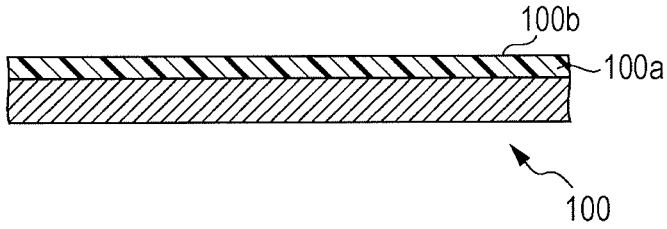
FIGS. 2A to 2D are explanatory views explaining a fluorocarbon resin dispersion layer of a transfer belt of the image forming apparatus in FIG. 1, FIG. 2A being a cross-sectional view of the transfer belt, FIGS. 2B, 2C, and 2D being views showing a toner image formation surface of the transfer belt.
Figure 2B:
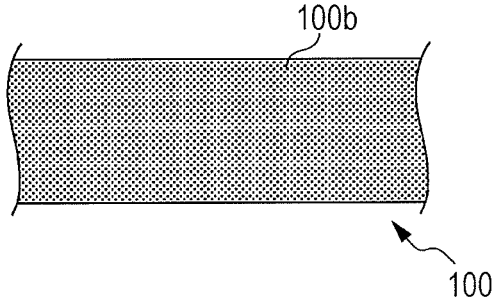

Fluorocarbon resin is uniformly dispersed as a dispersed material in the base material of the transfer belt 100. The base material may be any of, for example, polycarbonate, polyimide, and polyamide-imide (or a mixed material containing some of these materials). The dispersed material may be any of, for example, polytetrafluoroethylene (PTFE), fluorinated ethylene-propylene polymer (FEP), and poly vinylidene fluoride (PVDF) (or some of these materials). As shown in FIG. 2A, a fluorocarbon resin dispersion layer 100*a* with a thickness that is about ⅓ of the entire thickness (about 100 μm) of the transfer belt 100 is formed on a side of a toner image formation surface 100*b* (in the above description, referred to as the "outer peripheral surface," and hereinafter, occasionally referred to as a "surface"). An average particle diameter of the dispersed material is, for example, 0.2 μm. As shown in FIG. 2B, an area ratio of the base material to the dispersed material on the surface 100*b* of the transfer belt 100 is, for example, 7:3.

Figure 2C:
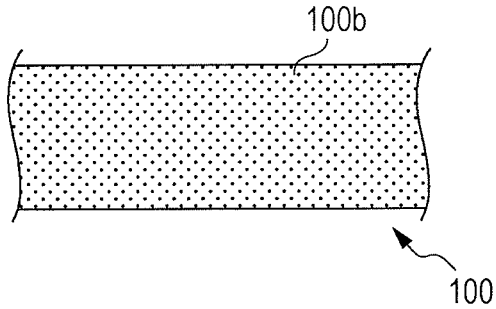
Figure 3:
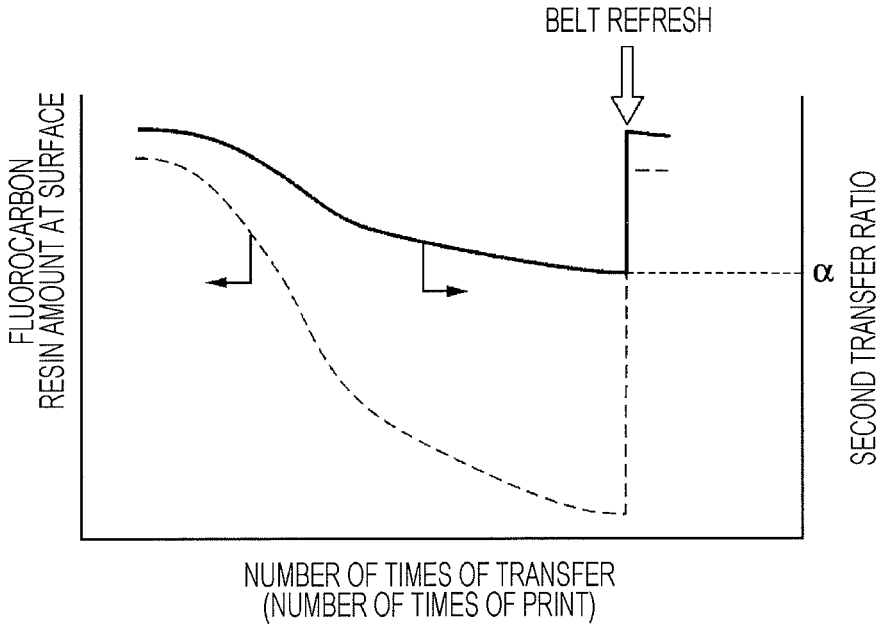
FIG. 3 is a graph showing the relationship between a fluorocarbon resin amount in a surface and a second transfer ratio, with respect to the number of times of transfer by the transfer belt of the image forming apparatus in FIG. 1.

FIG. 3 is a graph showing the relationship between an amount of the fluorocarbon resin at the surface 100*b* and a second transfer ratio, with respect to the number of times of transfer. The amount of the fluorocarbon resin at the surface 100*b* of the transfer belt 100 and the second transfer ratio are decreased as the number of times of transfer (the number of times of print) is increased. The amount of the fluorocarbon resin at the surface 100*b* of the transfer belt 100 is decreased because the dispersed material is dropped from the base material at the surface 100*b* of the transfer belt 100 as the transfer belt 100 is used (see FIG. 2C). Hence, the releasing performance for the toner is decreased, and the second transfer ratio is decreased.

Owing to this, the image forming apparatus 1 according to this exemplary embodiment includes the second transfer ratio detecting device including the first reflection density sensor 104 and the second reflection density sensor 106, and the abrading device 108. If the second transfer ratio detected by the second transfer ratio detecting device becomes smaller than a predetermined value α (see FIG. 3), the abrading belt 114 of the abrading device 108 comes into contact with the transfer belt 100, and abrades part of the surface layer of the transfer belt 100.

To be more specific, test-patch printing is performed when the image forming apparatus 1 is started or every constant time. The first reflection density sensor 104 detects a density A of a toner image of the test-patch print that is first-transferred on the transfer belt 100, and the second reflection density sensor 106 detects a density B of the toner image of the test-patch print remaining on the transfer belt 100 after the second transfer. For example, the second transfer ratio is calculated by an expression of (A−B)/A. If the calculated second transfer ratio is smaller than the value α, the abrading belt 114 of the abrading device 108 is driven to come into contact with the transfer belt 100. The transfer belt 100 is rotated by at least one turn, and then the abrading belt 114 is separated from the transfer belt 100. Accordingly, the surface layer of the transfer belt 100 is abraded by, for example, 0.2 μm, over the entire periphery.

Figure 2D:
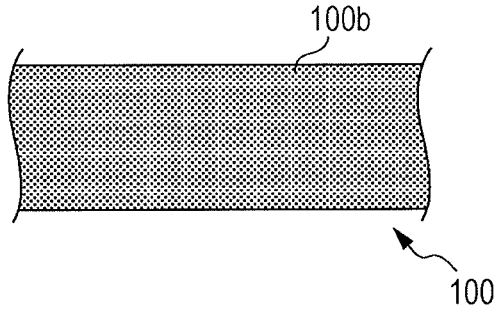

As described above, when the second transfer ratio is decreased, the deteriorated fluorocarbon resin dispersion layer at the surface 100*b* of the transfer belt 100 is abraded, and a new fluorocarbon resin dispersion layer 100*a* is exposed to the surface 100*b* of the belt (see FIG. 2D). Accordingly, as shown in FIG. 3, the amount of the fluorocarbon resin at the surface 100*b* of the transfer belt 100 and the second transfer ratio are recovered.

Meanwhile, the second transfer ratio depends on not only the amount of the fluorocarbon resin at the surface 100*b* of the transfer belt 100 but also a decrease in charging performance due to deterioration of a toner over time.

Figure 4:
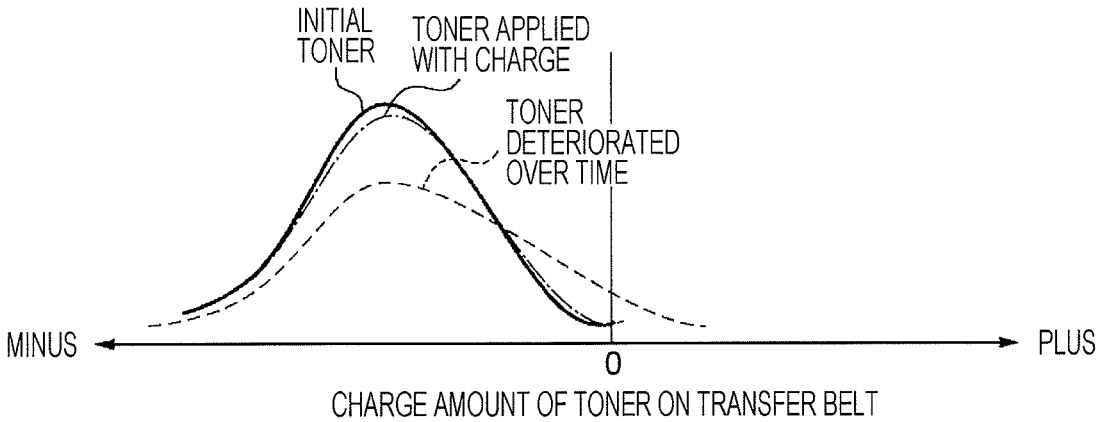
FIG. 4 is a graph showing a charge distribution of a toner on the transfer belt of the image forming apparatus in FIG. 1.

FIG. 4 is a graph showing a charge distribution of a toner on the transfer belt 100. As shown in FIG. 4, a charge distribution of a toner (a toner that is deteriorated over time) is shifted to the plus side as compared with a charge distribution of a toner (an initial toner) that is not deteriorated over time). That is, charging performance of the toner deteriorated over time is decreased. Hence, the action of the electrostatic attraction for the toner during the second transfer is decreased, and the second transfer ratio is decreased.

Owing to this, the image forming apparatus 1 according to this exemplary embodiment includes the corotron charger 102 as described above. When the test-patch printing is performed, the corotron charger 102 applies a minus charge to the toner image of the test-patch print that is first-transferred on the transfer belt 100.

As shown in FIG. 4, the charge distribution of a toner (a charged toner) with a charge applied by the corotron charger 102 is similar to that of the initial toner, even though the toner is deteriorated over time.

As described above, when the test-patch printing is performed and the second transfer ratio is detected, a change in second transfer ratio due to deterioration of the toner over time is eliminated. Thus, the decrease in second transfer ratio as a result of the deteriorated fluorocarbon resin dispersion layer at the surface layer of the transfer belt 100 is properly recognized, and then the transfer belt 100 may be abraded.

In the image forming apparatus 1 according to this exemplary embodiment, the corotron charger 102 applies a charge to a toner that is deteriorated over time. Alternatively, when the test-patch printing is performed, first transfer current provided by the first transfer device 20 may be at least 1.5 times higher than normal current, and a minus charge may be applied to a toner as compared with a normal charge. In this case, the corotron charger 102 may be eliminated, and hence the configuration may be simplified.

Also, in the image forming apparatus 1 according to this exemplary embodiment, the abrading belt 114 is employed as the abrading member in the abrading device 108. Alternatively, the abrading member may be formed of a roll-shaped member. The roll-shaped member has a simpler configuration. However, the belt-shaped member is more desirable because the belt-shaped member easily removes the chips from the transfer belt 100.

Also, since the cleaning device is additionally provided for the second transfer device 30, the toner image of the test-patch print may not be transferred on the recording paper P and may be transferred on the second transfer device 30. In this case, the recording paper P is not wasted, and the second transfer ratio is detected without a variation in detected result depending on the type of recording paper P.

Also, in the image forming apparatus 1 according to this exemplary embodiment, the thickness of the fluorocarbon resin dispersion layer 100*a* of the transfer belt 100 is ⅓ of the entire thickness of the transfer belt 100. Alternatively, fluorocarbon resin may be dispersed over the entire thickness of the transfer belt 100.

Also, in the image forming apparatus 1 according to this exemplary embodiment, the transfer belt 100 is employed as the transfer member. Alternatively, a transfer drum may be employed.

Also, in the image forming apparatus 1 according to this exemplary embodiment, the second transfer ratio, which is obtained by detecting the density A of the toner image before the second transfer and the density B of the toner image after the second transfer and by using the expression of (A−B)/A, is used. Alternatively, for example, a difference value obtained by an expression of A−B may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image holding body that holds an electrostatic latent image;

a developing device that develops the electrostatic latent image with a toner and forms a toner image on the image holding body;

a transfer member having a fluorocarbon resin dispersion layer at least at a surface layer of the transfer member, fluorocarbon resin being dispersed in the fluorocarbon resin dispersion layer;

a first transfer device that first-transfers the toner image, which is formed on the image holding body, on the transfer member;

a second transfer device that second-transfers the toner image, which is first-transferred on the transfer member, on a recording medium; and an abrading member that is arranged to come into contact with and be separated from the transfer member and is configured to abrade part of the surface layer of the transfer member when the abrading member contacts the transfer member, wherein the abrading member abrades the deteriorated fluorocarbon resin dispersion layer at the surface of the transfer member, and a new fluorocarbon resin dispersion layer is exposed to the surface of the member.

2. The image forming apparatus according to claim 1, further comprising:

a detector that detects a degree of the second transfer of the toner image from the transfer member to the recording medium, wherein the abrading member contacts the transfer member in accordance with the detected degree of the second transfer.

3. The image forming apparatus according to claim 1, further comprising a charge applying portion that applies a charge to the toner such that a change in the degree of the second transfer as a result of deterioration of the toner is reduced.

4. The image forming apparatus according to claim 1, wherein the abrading member is positioned downstream from the second transfer device.

* * * * *